US007152594B2

(12) United States Patent
Anilovich et al.

(10) Patent No.: US 7,152,594 B2
(45) Date of Patent: Dec. 26, 2006

(54) AIR/FUEL IMBALANCE DETECTION SYSTEM AND METHOD

(75) Inventors: Igor Anilovich, Walled Lake, MI (US); Louis A Avallone, Linden, MI (US); David N. Belton, Birmingham, MI (US); Ian J. Mac Ewen, White Lake, MI (US); Vincent A. White, Northville, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/198,194

(22) Filed: Aug. 5, 2005

(65) Prior Publication Data

US 2006/0260593 A1 Nov. 23, 2006

Related U.S. Application Data

(60) Provisional application No. 60/683,811, filed on May 23, 2005.

(51) Int. Cl.
*F02D 41/22* (2006.01)
*F02B 77/08* (2006.01)

(52) U.S. Cl. ..... 123/690; 123/198 D; 123/630; 701/107; 701/109; 60/277

(58) Field of Classification Search ..... 123/672–673, 123/679, 688, 690, 630, 198 D; 701/107, 701/109; 60/276, 277, 285; 73/117.3, 118.1
See application file for complete search history.

(56) References Cited

U.S. PATENT DOCUMENTS

| | | | | |
|---|---|---|---|---|
| 6,021,758 | A * | 2/2000 | Carey et al. | 123/436 |
| 6,032,659 | A * | 3/2000 | Yamashita et al. | 123/674 |
| 6,314,952 | B1 * | 11/2001 | Turin et al. | 123/673 |
| 6,382,198 | B1 | 5/2002 | Smith et al. | |
| 6,481,427 | B1 * | 11/2002 | Javaherian | 123/673 |
| 6,668,812 | B1 | 12/2003 | Javaherian | |
| 7,027,910 | B1 * | 4/2006 | Javaherian et al. | 701/111 |

OTHER PUBLICATIONS

Kainz, Jeff L. and Smith, James C., "Individual Cylinder Fuel Control With A Switching Oxygen Sensor", SAE, Mar. 1-4, 1999, pp. 1-8.

* cited by examiner

*Primary Examiner*—Hai Huynh
(74) *Attorney, Agent, or Firm*—Christopher Devries

(57) ABSTRACT

A method for detecting emissions from an internal combustion engine generally including determining a reference air/fuel mixture signal based on an engine speed and an airflow into the engine. The method includes determining an actual air/fuel mixture signal from an air/fuel mixture sensor and comparing the reference air/fuel mixture signal to the actual air/fuel mixture signal. The method also includes determining whether an air/fuel imbalance condition occurs based on the comparison and setting a service indicator based on the determination of whether the air/fuel imbalance condition occurred.

23 Claims, 3 Drawing Sheets

AIR/FUEL IMBALANCE DETECTION SYSTEM AND METHOD

CROSS-REFERENCE TO RELATED APPLICATIONS

This application claims the benefit of U.S. Provisional Application No. 60/683,811 filed on May 23, 2005. The disclosure of the above application is incorporated herein by reference.

FIELD OF THE INVENTION

The present invention relates to engine control and more specifically relates to engine emission control using an air/fuel imbalance detection.

BACKGROUND OF THE INVENTION

Internal combustion engines compress and ignite a fuel and an air mixture in a cylinder to produce power. Any imbalance in the air/fuel mixture may produce unwanted emissions in exhaust gases exiting the cylinders. An oxygen concentration sensor may measure oxygen concentration levels in the exhaust gas. By measuring the oxygen concentration in the exhaust gas, the air/fuel mixture may be adjusted to improve efficiency and reduce unwanted emissions.

SUMMARY OF THE INVENTION

A method for detecting emissions from an internal combustion engine generally including determining a reference air/fuel mixture signal based on an engine speed and an airflow into the engine, determining an actual air/fuel mixture signal from an air/fuel mixture sensor, comparing the reference air/fuel mixture signal to the actual air/fuel mixture signal, determining whether an air/fuel imbalance condition occurs based on the comparison, and setting a service indicator based on the determination of whether the air/fuel imbalance condition occurred.

In one feature, determining the reference air/fuel mixture signal includes obtaining a reference signal from a look-up table based on the engine speed and the airflow into the engine.

In another feature, determining whether the air/fuel imbalance condition occurs based on the comparison includes determining whether the actual air/fuel mixture signal has greater high frequency content than the reference air/fuel mixture signal.

In still another feature, determining whether the air/fuel imbalance condition occurs based on the comparison includes determining whether the actual air/fuel mixture signal has a longer trace length than the reference air/fuel mixture signal.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description, the appended claims and the accompanying drawings, wherein:

DETAILED DESCRIPTION OF THE VARIOUS EMBODIMENTS

The following description of the various embodiments is merely exemplary in nature and is in no way intended to limit the invention, its application or uses. As used herein, the term module refers to an application specific integrated circuit (ASIC), an electronic circuit, a processor (shared, dedicated, or group) and memory that executes one or more software or firmware programs, a combinational logic circuit, and/or other suitable components and combinations thereof that provide the described functionality. Moreover, vehicle control modules may communicate with various vehicle systems using digital and/or analog inputs and outputs and/or an automotive communications network including, but not limited to, the following commonly used vehicle communications network standards: CAN, SAE J1850, and GMLAN.

Figure 1:
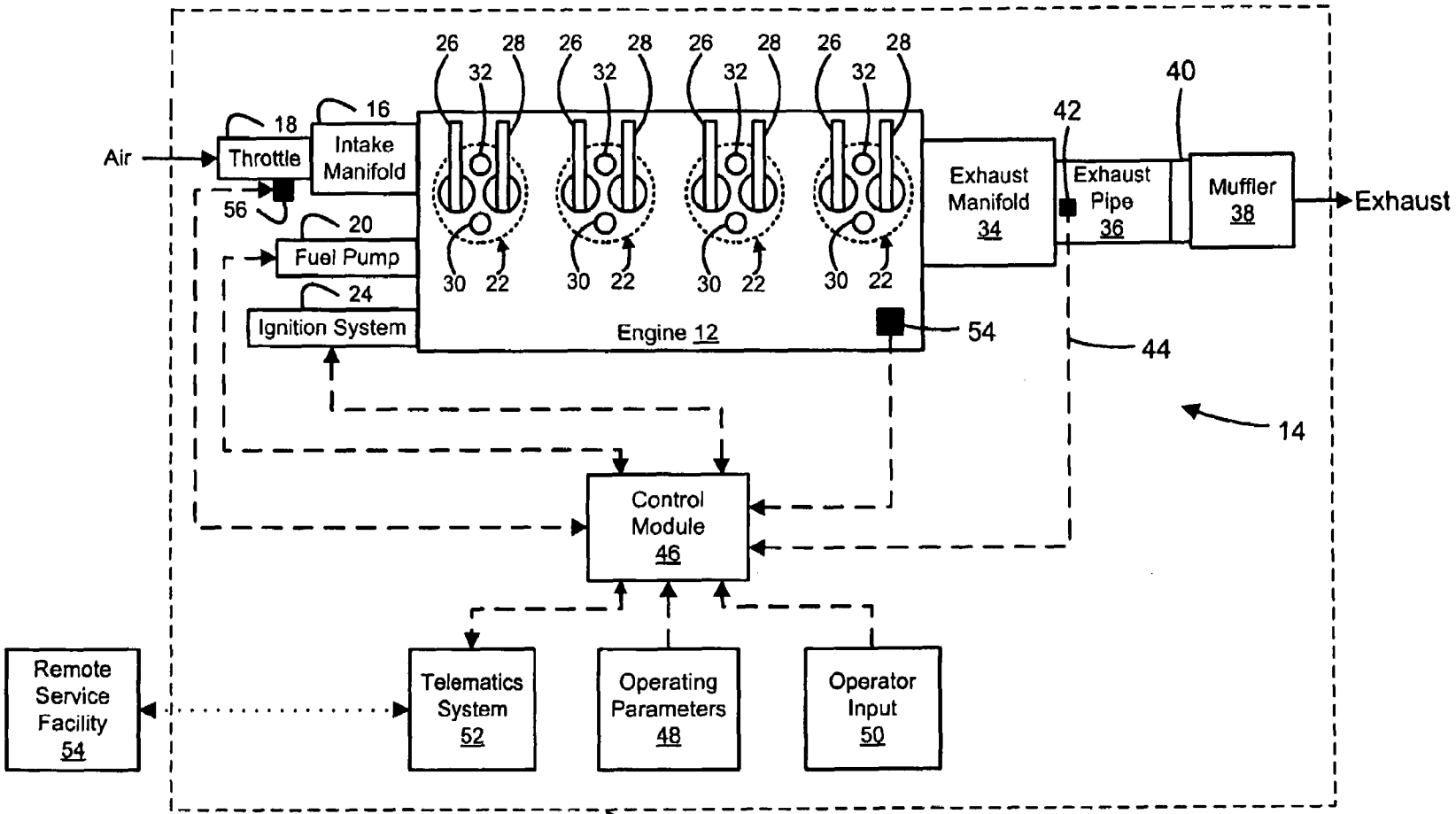
FIG. 1 is a schematic diagram illustrating an engine including a control constructed in accordance with the teachings of the present invention.

Referring now to FIG. 1, a vehicle 10 includes an engine 12 having an air/fuel imbalance detection system 14. In one example, the engine 12 is an internal combustion engine that produces a torque output, which may be transmitted to wheels via a power train (not shown). By way of the above example, the engine 12 includes an intake manifold 16 and a throttle 18 that regulates airflow into the intake manifold 16. The airflow from the intake manifold 16 and fuel from a fuel pump 20 is distributed into a plurality of cylinders 22 and ignited by an ignition system 24. While four cylinders 22 are illustrated in FIG. 1, it will be appreciated that a varying number of cylinders 22 may be used, for example, 2, 3, 5, 6, 8, 10, 12 etc.

Each of the cylinders 22 includes an intake valve 26, an exhaust valve 28, a spark plug 30, and a fuel injector valve 32 to regulate combustion in the cylinders 22. Each of the cylinders may have more than one intake valve 26, exhaust valve 28, spark plug 30, and/or fuel injector valve 32. An overhead camshaft (not shown) or push rods with an internal cam (not shown) may actuate each of the intake valves 26 and the exhaust valves 28 via rocker arms or cam followers (not shown). Each of the spark plugs 30 may connect to the ignition system 24 and ignite the air/fuel mixture in each cylinder 22. The fuel pump 20 may pressurize fuel within a fuel system that is delivered to each of the fuel injector valves 32 and is selectively atomized into the respective cylinder 22.

An exhaust manifold 34 receives exhaust (i.e., combustion gases) from each of the cylinders 22 and sends the exhaust through an exhaust pipe 36 to a muffler 38. From the muffler 38, the exhaust vents to the atmosphere. A catalytic converter 40 may couple between the exhaust pipe 36 and the muffler 38 to reduce emissions in the exhaust.

In one example, an air/fuel mixture sensor 42 may couple to the exhaust pipe 36 at a location between the exhaust manifold 34 and the catalytic converter 40. The air/fuel mixture sensor 42 samples exhaust gases traveling through the exhaust pipe 36 and may detect, for example, oxygen concentration, exhaust gas temperature and/or humidity of the exhaust gas. One type of air/fuel mixture sensor 42 may be, for example, an oxygen concentration sensor (02 sensor) that detects diatomic oxygen content in the exhaust gas and sends an air/fuel mixture signal 44 to a control module 46. The air/fuel mixture signal 44 may include a voltage that is commensurate with the quantity of oxygen.

In one example, the signal 44 from the air/fuel mixture sensor 42 may have a sinusoidal-shape because of the reciprocal nature on the internal combustion engine 12. In one example, the air/fuel mixture sensor 42 is an oxygen concentration sensor that supplies an oxygen concentration signal. As the engine speed increases and/or airflow into the engine 12 increases, the frequency and/or the magnitude of the signal 44 may increase. It may be shown that when air/fuel imbalance occurs in the engine 12, the signal 44 from the air/fuel mixture sensor 42 will have additional high-frequency content in addition to a portion of the signal from normal combustion. In one example, one fuel injector in the respective cylinder may become partially clogged and thus impede proper combustion. The improper combustion may produce unwanted emissions. Notwithstanding, other fuel injectors in the engine 12 may operate in a normal fashion. By way of the above example, the air/fuel mixture sensor 42 would produce additional high-frequency content due to the abnormally operating (e.g., partially clogged) fuel injector.

The control module 46 controls various operations of the air/fuel imbalance detection system 14 and engine 12 based on various inputs including engine operating parameters 48 and operator inputs 50. While a single control module 46 is shown, one or more control modules 46 may be implemented. Furthermore, the control module-46 may include various submodules. The operating parameters 48 may include, for example, environmental indicators such as ambient humidity, temperature and/or air pressure. The operator inputs 50 may include, for example, an accelerator pedal position, a brake pedal position and other inputs known in the art. A telematics system 52, such as OnStar®, may also provide input and receive output from the control module 46. Moreover, the telematics system 52 may communicate with a remote service facility 54.

The control module 46 may communicate with the air/fuel mixture sensor 42 and receive the air/fuel mixture signal 44 therefrom. The control module 46 may also communicate with an engine sensor 54. The engine sensor 54 may include one or more sensors that may communicate, for example, engine speed, engine temperature and/or engine oil pressure to the control module 46. The control module 46 may communicate with a throttle sensor 56 to determine and/or control a position of the throttle 18. The throttle sensor 56 may include one or more sensors. For example, the throttle sensor 54 may include an airflow sensor that determines the amount of air flowing into the intake manifold 16 downstream of the throttle 18. In another example, the throttle sensor 56 may include a temperature sensor and a humidity sensor to determine the temperature and humidity of airflow into the intake manifold 16.

Figure 2:
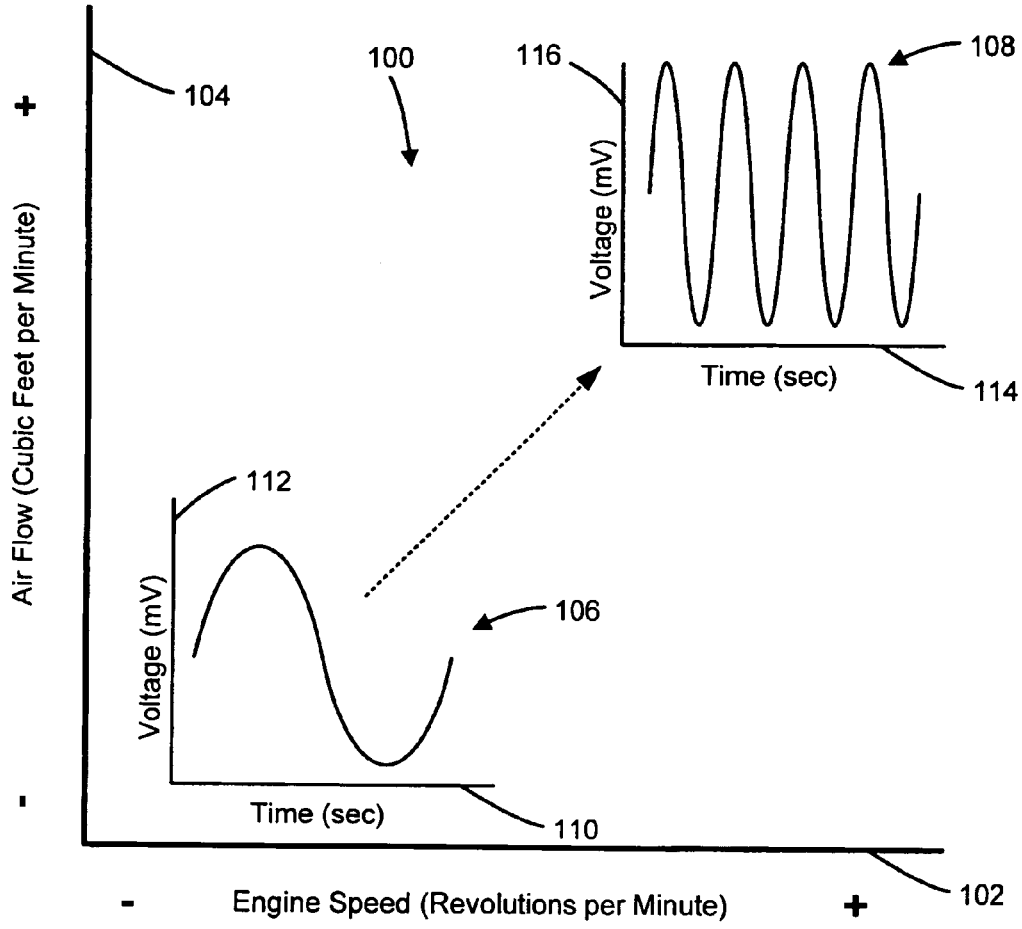
FIG. 2 is a diagram illustrating an exemplary increase in high-frequency content in an air/fuel mixture sensor signal as airflow into an engine and engine speed increases.

With reference to FIG. 2, the control module 46 (FIG. 1) may include a look-up table 100. The look-up table 100 includes a first axis 102 that represents increasing (right to left) engine speed (e.g., in revolutions per minute). A second axis 104 represents increasing (bottom to top) airflow (e.g., in cubic feet per minute) through the intake manifold 16 (FIG. 1). A first waveform 106 represents the air/fuel mixture signal 44 from the air/fuel mixture sensor 42 (FIG. 1). In one example, the first waveform 106 is a graphical representation of the signal 44 expressed in voltage (e.g., in micro-volts) over a time period (e.g., in seconds) from the air/fuel mixture sensor 42. By way 1 the above example, the voltage is a based on (i.e., a function of) an oxygen concentration in the exhaust gases. The waveform 106 may have the sinusoidal-shape because of the reciprocating nature of the internal combustion engine 12. A second waveform 108 is also a graphical representation of the signal 44 voltage expressed over time and shows a waveform of increased frequency and/or magnitude because of the increased engine speed and/or airflow into the engine 12 (FIG. 1):

The first waveform 106 has a first axis 110 that represents time (e.g., in seconds) and a second axis 112 that represent voltage (e.g., in micro-volts). The second waveform 108 has first axis 114 that represents time (e.g., in seconds) and a second axis 116 that represent voltage (e.g., in micro-volts). It will be appreciated that while not specifically illustrated, the look-up table 100 contains a plurality of waveforms that represent the signals 44 from the air/fuel mixture sensor 42 (FIG. 1) based on engine speed and airflow into the engine 12 (FIG. 1).

In one example, a time increment over which each reference signal from the air/fuel mixture sensor 42 obtained is five seconds. By way of the above example, a plurality of reference signals each having a five-second time increment is stored in the look-up table 100. The reference signals are based on engine speed and/or airflow and may be accessed by the control module 46 for comparison to an actual signal 44 from the airflow mixture sensor 42. It will be appreciated that the period time may vary based various considerations, for example engine size, operating parameters and/or engine speed. It will also be appreciated that the look-up table 100 may be populated with the plurality of reference waveforms in an a priori fashion (e.g., pre-programmed in a factory setting) and/or in an in-situ fashion (i.e., programmed (or re-programmed) at some point after delivery of the vehicle to the customer). The look-up table 100 may also be programmed (or re-programmed) via the telematic system 52.

With reference to FIGS. 1 and 2, the air/fuel imbalance detection system 14 may determine an air/fuel imbalance that may produce unwanted emissions. The air/fuel mixture sensor 42 detects the actual air/fuel mixture signal 44. The signal 44 is acquired over a predetermined period of time, for example, five seconds. At the end of the predetermined period of time, the air/fuel imbalance detection system 14 associates the period time with an engine speed and an airflow. A reference signal from the air/fuel mixture sensor 42 based on the associated engine speed and the associated airflow is obtained and compared to the actual air/fuel mixture signal 44. It will be appreciated that the reference signal from the air/fuel mixture sensor may be acquired from the look-up table 100. Based on the comparison, the air/fuel imbalance detection system 14 determines if an air/fuel imbalance condition occurs. When the air/fuel imbalance occurs, the air/fuel imbalance detection system 14 may set a service indicator. Based on the service indicator, the air/fuel imbalance detection system 14 may illuminate a service light, adjust the amount of fuel injected by the fuel injectors and/or contact a remote service facility through the telematic system 52.

In one example, the signal from the air/fuel mixture sensor 42 will not indicate an air/fuel imbalance in the engine 12. In another example, the engine 12 may operate with additional fuel (i.e., run rich) than in a nominal condition. By way of the above examples, a non-nominal condition includes, but is not limited to, an engine 12 operating below normal operating temperature (e.g., a cold engine), which may require the engine 12 to operate with a rich air/fuel mixture. More specifically, the control module 46 may control fuel flow to the engine 12 based on a stoichiometric estimation of how much fuel is needed in the engine 12. In this arrangement, the air/fuel mixture sensor 42 may be in a closed loop control with the fuel injectors 30 and the control module 46. In a non-nominal condition, the fuel injectors 30 add more or less fuel then the stoichiometric estimate to provide, for example, the rich air/fuel mixture. In this arrangement, there may be an open-loop control of the fuel injectors 30 and the air/fuel mixture sensor 42 rather than a closed-loop control. It will be appreciated that the air/fuel mixture sensor 42 may sample the exhaust gases to stoichiometrically estimate how much fuel is needed for combustion in the engine 12.

Figure 3:
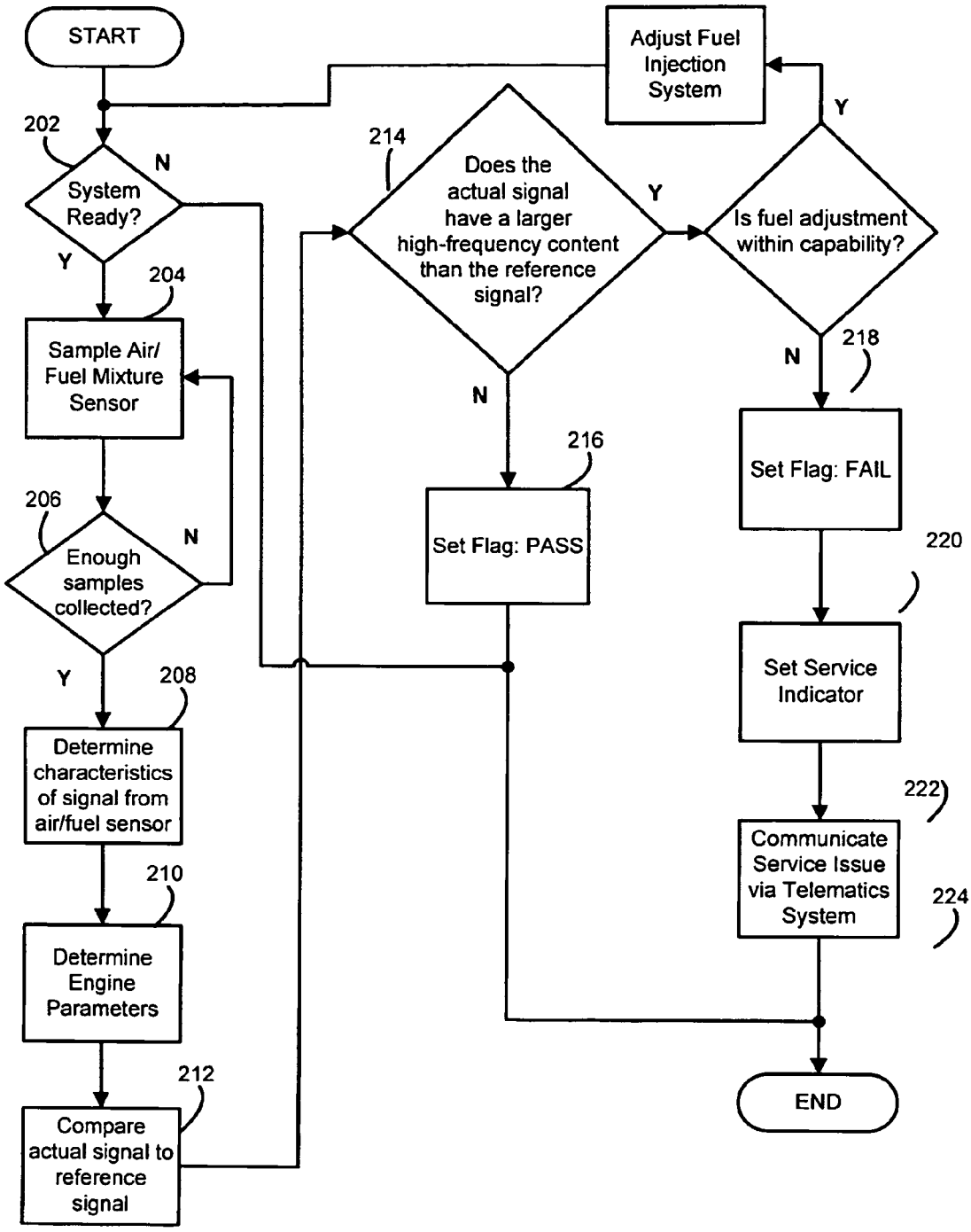
FIG. 3 is a flow chart illustrating an exemplary air/fuel imbalance detection system constructed in accordance with the teachings of the present invention.

With reference to FIG. 3, a fuel imbalance detection system 200 determines a high frequency content in the signal 44 (FIG. 1) from an air/fuel mixture sensor 42 (FIG. 1) to determine if an air/fuel imbalance has occurred. In step 202, control determines whether the system is ready. The system ready determination may be based on control module faults, operating parameters, engine speed and engine load. The engine ready determination may also be based on whether the engine 12 is in closed loop control with the air/fuel mixture sensor. If the system is ready, control continues in step 204. If the system is not ready, control ends.

In step 204, control samples the air/fuel mixture sensor 42 (FIG. 1). In one example, the air/fuel mixture sensor 42 is an $O_2$ sensor. In one example, control samples the air/fuel mixture sensor 42 over a predetermined period, for example five seconds. It will be appreciated that other periods may be used that may otherwise be suitable for certain engine models and certain operating parameters. It will also be appreciated that the signal 44 (FIG. 1) from the air/fuel mixture sensor 42 may be expressed in voltage and be in a sinusoidal pattern.

In step 206, control determines whether enough samples have been collected. Control determines, for example, that enough sample have been collected when there is sufficient data obtained throughout the above-determined period. In one example, voltage is collected in about 12.5 millisecond increments over a five-second period, thus collecting 400 voltage samples. When control has determined that enough samples have been collected, control continues in step 208. When control determines that enough samples have not been collected, control loops back to step 204.

In step 208, control determines characteristics of the output from the air/fuel mixture sensor 42 (FIG. 1). In one example, control determines the length of a signal trace (i.e., graphical representation of the waveform) from the air/fuel mixture sensor 42. More specifically, control determines the length of the trace from the air/fuel mixture sensor 42 by measuring individual line segment lengths over the period. By way of the above example, the voltage is acquired about every 12.5 milliseconds therefore a first voltage (i.e., $V_1$) is acquired at a first time (i.e., $T_1$) and a second voltage (i.e., $V_2$) is acquired at a second time (i.e., $T_2$). A third voltage (i.e., $V_3$) is acquired at a third time (i.e., $T_3$), such that the difference between the first time ($T_1$) and the second time ($T_2$) and the third time ($T_3$) is, for example, about 12.5 milliseconds respectively. The following equations may be used, for example, to determine the length of the trace from the first voltage ($V_1$) to the second voltage ($V_2$) and the second voltage ($V_2$) to the third voltage ($V_3$).

$$\overrightarrow{12} = \sqrt{\frac{(V_2 - V_1)^2}{(T_2 - T_1)^2}} \text{ and } \overrightarrow{23} = \sqrt{\frac{(V_3 - V_2)^2}{(T_3 - T_2)^2}}$$

By way of the above example, about 400 samples may be collected when each sample is collected over about the 12.5 millisecond increment and the sample length is about 5 seconds. The following equation may be used to sum all of the individual line segment values to get an estimation of trace length across the sample.

$$\text{Trace Length} = \Sigma\sqrt{\frac{(V_2 - V_1)}{(T_2 - T_1)}} + \sqrt{\frac{(V_3 - V_2)}{(T_3 - T_2)}} + \ldots \sqrt{\frac{(V_m - V_n)}{(T_m - T_n)}},$$

wherein n=1, 2, 3 . . . 397, 398, 399 and m=n+1.

It will be appreciated that the above formulae for line segment length only approximates the length of the sinusoidal waveform, as the above equations assume a straight-line measurement. Notwithstanding, the above equations may also be used to determine trace length of each of the reference waveforms in the look-up table 100 (FIG. 2) for comparison therewith. As such, the estimation has been shown to provide sufficient accuracy. In another example, control may determine trace length and/or other characteristics of the waveform using other suitable mathematical principles, for example but not limited to, Fourier transforms and/or other waveform matching algorithms.

In step 210, control determines engine parameters. In one example, control determines engine speed and airflow into the intake manifold 16 (FIG. 1). In another example, control may determine engine load, ambient temperature, and throttle position. In step 212, control compares the output from the air/fuel mixture sensor 42 (i.e., the actual signal) to a reference value (e.g., an earlier acquired signal) whose selection is based on the vehicle parameters determined in step 210. In one-example, control compares the actual signal obtained from the air/fuel mixture sensor 42 (FIG. 1) and compares it to the reference signal obtained in the look-up table 100 (FIG. 2). The engine parameters, determined in step 210, are associated with the actual signal determined in step 208. The same engine parameters are associated with a waveform in the look-up table 100 to obtain a reference signal therefrom. In one example, control may compare the relative high frequency content of the actual output signal and the reference signal. In another example, control may determine the length of the signal trace of the actual signal from the air/fuel mixture sensor. Control then compares the actual signal trace length to the reference signal trace length. By way of the above example, control may determine if the high frequency content of the actual signal from the air/fuel mixture sensor has relatively greater high frequency content than the reference signal.

In step 214, control determines whether an air/fuel imbalance exists in the engine 12. In one example, control determines whether the actual signal 44 (FIG. 1) from the air/fuel mixture sensor 42 has greater high frequency content than the reference signal. When control determines that the actual signal 44 from the air/fuel mixture sensor 42 has less high frequency content than the reference signal, control continues in step 216. When control determines that the actual signal 44 from the air/fuel mixture sensor 42 has greater high-frequency content than the reference signal, control continues in step 218. In step 216, control sets a pass flag. From step 216, control ends. In step 218, control sets a fail flag. From step 218, control continues in step 220.

In step 220, control may set a service indicator. Setting of the service indicator may include notifying the driver of a problem with the engine 12. In one example, setting of the service indicator may include illuminating an indicator on the dashboard (not shown). In another example, setting the service indicator may include setting a flag in the control module 46 (i.e., the engine computer), so when the driver brings the vehicle to a service facility, a service technician may detect the flag during an exemplary diagnostic procedure (not shown but well known in the art).

In step 222, control may adjust the fuel injection system parameters to compensate for the imbalance. In one example, the fuel injection valves may be adjusted to compensate for blockage in one or more fuel injection valve. One such imbalance correction system, for example, is disclosed in commonly assigned U.S. Pat. No. 6,668,812, entitled Individual Cylinder Controller for Three-Cylinder Engine, issued Dec. 30, 2003, which is hereby incorporated by reference as if fully set forth herein.

In step 224, control may communicate the service indicator via a telematic system 52 (FIG. 1) to a customer service facility 54 (FIG. 1). In one example, control may communicate that an air fuel imbalance has occurred and further communicate the results of the above test via the telematic system 52 to the customer service facility 54. Form step 224, control ends.

Those skilled in the art can now appreciate from the foregoing description that the broad teachings of the present invention may be implemented in a variety of forms. Therefore, while this invention has been described in connection with particular examples thereof, the true scope of the invention should not be so limited since other modifications will become apparent to the practitioner upon a study of the drawings, the specification and the following claims.

What is claimed is:

1. A method for detecting emissions from an internal combustion engine comprising:

determining a reference air/fuel mixture signal based on an engine speed and an airflow into the engine;

determining an actual air/fuel mixture signal from an air/fuel mixture sensor;

comparing said reference air/fuel mixture signal to said actual air/fuel mixture signal;

determining whether an air/fuel imbalance condition occurs based on said comparison; and setting a service indicator based on said determination of whether said air/fuel imbalance condition occurred.

2. The method of claim 1 wherein determining said reference air/fuel mixture signal includes obtaining a reference signal from a look-up table based on said engine speed and said airflow into the engine.

3. The method of claim 1 wherein determining whether said air/fuel imbalance condition occurs based on said comparison includes determining whether said actual air/fuel mixture signal has greater high-frequency content than said reference air/fuel mixture signal.

4. The method of claim 1 wherein determining whether said air/fuel imbalance condition occurs based on said comparison includes determining whether said actual air/fuel mixture signal has a longer trace length than said reference air/fuel mixture signal.

5. The method of claim 1 further comprising locating said air/fuel mixture sensor upstream of a catalytic converter and downstream of an exhaust manifold.

6. The method of claim 1 further comprising adjusting at least one fuel injection valve based on said determination of whether said air/fuel imbalance condition occurred.

7. The method of claim 1 further comprising contacting a remote service facility via a telematic system based on said determination of whether said air/fuel imbalance condition occurred.

8. A method for detecting emissions from an internal combustion engine comprising:

determining a reference oxygen concentration signal based on an engine speed and an airflow into the engine;

determining an actual oxygen concentration signal based on an oxygen concentration sensor;

comparing said reference oxygen concentration signal to said actual oxygen concentration signal, wherein said comparison includes comparing a trace length of said reference oxygen concentration signal to a trace length of said actual oxygen concentration signal; and determining whether an air/fuel imbalance condition occurs when said trace length of said actual oxygen concentration signal is greater than said trace length of said actual oxygen concentration signal.

9. The method of claim 8 further comprising setting a service indicator based on said determination of whether said air/fuel imbalance condition occurred.

10. The method of claim 8 wherein determining said reference oxygen concentration signal based on said engine speed and said airflow into the engine includes obtaining a reference signal from a look-up table based on said engine speed and said airflow into the engine.

11. The method of claim 8 wherein determining whether said air/fuel imbalance condition occurs based on said comparison includes determining whether said actual oxygen concentration signal has greater high-frequency content than said reference oxygen concentration signal.

12. The method of claim 8 wherein determining whether said air/fuel imbalance condition occurs based on said comparison includes determining whether said actual oxygen concentration signal has a longer trace length than said reference oxygen concentration signal.

13. The method of claim 8 further comprising locating said oxygen concentration sensor upstream of a catalytic converter and downstream of an exhaust manifold.

14. The method of claim 8 further comprising adjusting at least one fuel injection valve based on said determination of whether said air/fuel imbalance condition occurred.

15. The method of claim 8 further comprising contacting a remote service facility via a telematic system based on said determination of whether said air/fuel imbalance condition occurred.

16. An air/fuel imbalance detection system comprising:

an engine having at least one cylinder that produces combustion gases;

an exhaust manifold connected to said at least one cylinder;

an air/fuel mixture sensor connected to said exhaust manifold that samples said combustion gases; and a control module that determines a reference air/fuel mixture signal based on an engine speed and an airflow into said engine, that determines an actual air/fuel mixture signal based from said air/fuel mixture sensor that compares said reference air/fuel mixture signal to said actual air/fuel mixture signal, that determines whether an air/fuel imbalance condition occurs based on said comparison, and that sets a service indicator based on said determination of whether said air/fuel imbalance condition occurred.

17. The air/fuel imbalance detection system of claim 16 wherein said control module sets a service indicator based on said determination of whether said air/fuel imbalance condition occurred.

18. The air/fuel imbalance detection system of claim 16 wherein said control module obtains a reference signal from a look-up table based on said engine speed and said airflow into the engine.

19. The air/fuel imbalance detection system of claim 16 wherein said control module determines whether said actual air/fuel mixture signal has greater high-frequency content than said reference air/fuel mixture signal.

20. The air/fuel imbalance detection system of claim 16 wherein said control module determines whether said actual air/fuel mixture signal has a longer trace length than said reference air/fuel mixture signal.

21. The air/fuel imbalance detection system of claim 16 wherein said air/fuel mixture sensor is upstream of a catalytic converter.

22. The air/fuel imbalance detection system of claim 16 wherein said control module adjusts at least one fuel injection valve based on said determination of whether said air/fuel imbalance condition occurred.

23. The air/fuel imbalance detection system of claim 16 wherein said control, module contacts a remote service facility via a telematic system based on said determination of whether said air/fuel imbalance condition occurred.

* * * * *